US007422069B2

(12) United States Patent
Richard et al.

(10) Patent No.: US 7,422,069 B2
(45) Date of Patent: Sep. 9, 2008

(54) TELESCOPING CENTRALIZERS FOR EXPANDABLE TUBULARS

(75) Inventors: Bennett M. Richard, Kingwood, TX (US); Steve Rosenblatt, Haddonfield, NJ (US)

(73) Assignee: Baker Hughes Incorporated, Houston, TX (US)

( * ) Notice: Subject to any disclaimer, the term of this patent is extended or adjusted under 35 U.S.C. 154(b) by 606 days.

(21) Appl. No.: 10/648,955

(22) Filed: Aug. 27, 2003

(65) Prior Publication Data

US 2004/0079535 A1 Apr. 29, 2004

Related U.S. Application Data

(60) Provisional application No. 60/421,491, filed on Oct. 25, 2002.

(51) Int. Cl.
*E21B 43/10* (2006.01)

(52) U.S. Cl. ..... 166/382; 166/207; 166/384

(58) Field of Classification Search ..... 166/206, 166/207, 382, 384
See application file for complete search history.

(56) References Cited

U.S. PATENT DOCUMENTS

| | | | | |
|---|---|---|---|---|
| 2,874,783 | A | 2/1959 | Haines | |
| 5,165,478 | A | 11/1992 | Wilson | |
| 5,224,556 | A | 7/1993 | Wilson et al. | |
| 5,228,518 | A * | 7/1993 | Wilson et al. | 166/369 |
| 5,346,016 | A | 9/1994 | Wilson et al. | |
| 5,348,095 | A * | 9/1994 | Worrall et al. | 166/380 |
| 5,379,838 | A | 1/1995 | Wilson et al. | |
| 6,112,808 | A * | 9/2000 | Isted | 166/60 |
| 6,543,545 | B1 * | 4/2003 | Chatterji et al. | 166/381 |
| 6,561,271 | B2 * | 5/2003 | Baugh et al. | 166/285 |
| 2003/0047322 | A1 * | 3/2003 | Maguire et al. | 166/380 |

FOREIGN PATENT DOCUMENTS

| | | |
|---|---|---|
| GB | 2345308 A | 7/2000 |
| WO | WO 94/13928 | 6/1994 |
| WO | WO 02/25056 A1 | 3/2002 |

* cited by examiner

*Primary Examiner*—Giovanna C Wright
(74) *Attorney, Agent, or Firm*—Steven Rosenblatt

(57) ABSTRACT

A method of centralizing tubulars prior to cementing and subsequent expansion involves using a plurality of telescoping cylinders whose leading or trailing end is closed and which are extended by applied internal pressure in the tubular or some mechanical means. The tubular is expanded from its interior with the cylindrical telescoping members still extended. The cement is pushed all around the tubular due to the centralizers. After the cement is delivered the expansion of the tubular pushes the telescoping members into the borehole wall.

20 Claims, 1 Drawing Sheet

TELESCOPING CENTRALIZERS FOR EXPANDABLE TUBULARS

PRIORITY INFORMATION

This application claims the benefit of U.S. Provisional Application No. 60/421,491 on Oct. 25, 2002.

FIELD OF THE INVENTION

The field of this invention relates to completion techniques for tubulars that are centralized prior to cementing and subsequently expanded, and more particularly to telescoping centralizers in this application.

BACKGROUND OF THE INVENTION

When cementing a tubular, centralizers have been used to allow the cement to work its way fully around the tubular. Without centralizers, particularly if there is a deviation in the wellbore, there was a risk that the tubular would lay up against the borehole wall on the low side undermining the benefit of the cement in trying to seal around the tubular.

Centralizers of various types have been used in the past. The most common centralizers comprise a plurality of spaced flexible strips that extend longitudinally between a pair of end rings. The centralizers are slipped over the end of the tubular on makeup or get clamped to the tubular due to a hinge connection in each of the two end rings. These centralizers are typically made of steel. The problem with these centralizers arises if there is to be any pipe expansion. Expanding tubulars has become a more widely used procedure and such centralizers have been known to cause high stress areas on the underlying tubular during expansion to the point where the tubular can split or crack. Attempts to improve on the metal centralizers described above by making them from a polymeric material have had mixed results. The problem there has been that they are not strong enough to hold their shape to the extent that their main purpose of centralizing is defeated. Also, their geometric dimensions do not lend themselves to be run through the previous casing string and yet still have enough standoff for suitable centralization.

Centralizing devices have also been used that are bulky and that have many moving parts. These designs are expensive, require inordinate maintenance, and are simply too large to be of use in many applications. Some examples are U.S. Pat. No. 2,874,783 and PCT Application WO 94/13928.

Another centralizing technique for cementing tubulars has been to use telescoping cylinders that can be pushed out when the tubular is in position. These cylinders had removable barriers to let flow go through them after extension. One of their uses was to centralize a tubular prior to cementing. Some illustrations of this type of centralizing system can be found in U.S. Pat. Nos. 5,228,518; 5,346,016; 5,379,838; 5,224,556; and 5,165,478. None of these centralizers were used in combination with tubulars that were to be expanded. Yet, despite the use of extendable cylinders to centralize prior to cementing, in applications where the tubular was to be expanded after cementing there was either no attempt to cement in an inclined wellbore or centralizers that wrapped around the tubular and caused stress failures when expanded were used. As a result, poor cement distribution occurred that was compounded by the subsequent expansion of the tubular. What is needed and addressed by the present invention is an effective way to centralize a tubular before it is cemented and subsequently expanded even if it is disposed in a deviated bore. The method of the present invention is to centralize using telescoping cylinders and then with the cylinders extended to expand the tubular internally to compact the setting cement and provide a reliable seal of the tubular despite the angle of inclination of the associated wellbore. These and other aspects of the present invention will be more apparent to those skilled in the art from a review of the description of the preferred embodiment and the claims, which appear below.

SUMMARY OF THE INVENTION

A method of centralizing tubulars prior to cementing and subsequent expansion involves using a plurality of telescoping cylinders whose leading or trailing end is closed and which are extended by applied internal pressure in the tubular or some mechanical means. The tubular is expanded from its interior with the cylindrical telescoping members still extended. The cement is pushed all around the tubular due to the centralizers. After the cement is delivered the expansion of the tubular pushes the telescoping members into the borehole wall.

DETAILED DESCRIPTION OF THE PREFERRED EMBODIMENT

Figure 1:
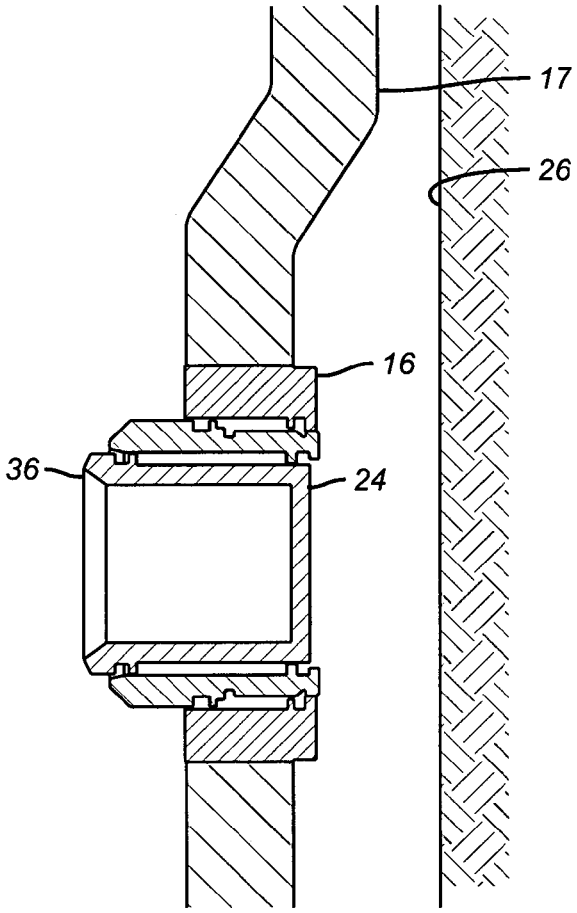
FIG. 1 is a section view of a telescoping member having a closed leading end and in the run in position showing the total extension as less than the connection or upset dimension.

Referring to FIG. 1 the wall of tubular 10 is shown with an opening 12. The opening 12 is one of a plurality of similar openings distributed around the tubular 10. In each opening 12 is a sleeve 14 that is firmly secured in opening 12. It has a leading end 16 that is either flush or slightly extending beyond the outer wall surface 18 of tubular 10. Leading end 16 should not extend beyond the dimension of the connection or upset 17.

Figure 2:
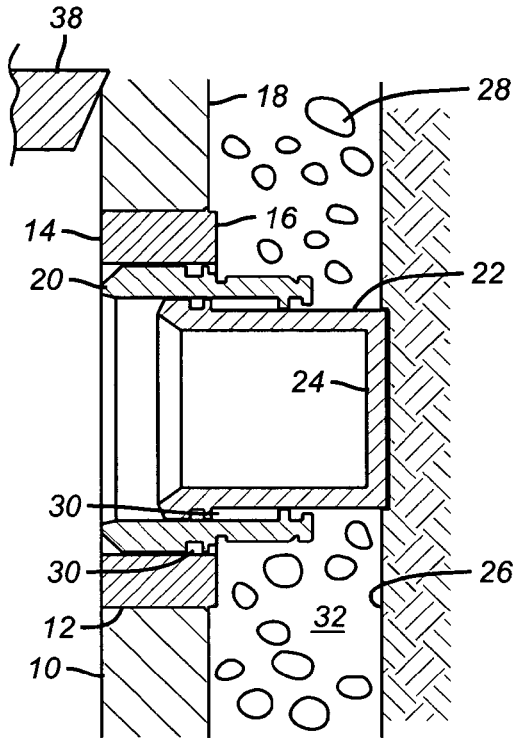
FIG. 2 is a section view of a telescoping member of FIG. 1, shown in the extended position.

Alternatively, the leading end 16 can be slightly recessed into opening 12. An outer piston 20 is slidably mounted to sleeve 14 to extend a predetermined amount before a travel stop is engaged. An inner piston 22 telescopes with respect to the outer piston 20 and has its leading end 24 closed off. The leading end 24 is advanced by internal fluid pressure or mechanical force into contact with the borehole wall 26 in a plurality of directions to centralize the tubular 10 prior to the pumping of cement 28. Locking ratchet mechanisms, shown schematically as 30 keep the outer piston 20 and the inner piston 22 in the position they achieve after application of pressure to the inside of the tubular 10. In that manner the pumped cement or other sealing material 28 cannot push the pistons 20 and 22 back in after they are extended. The applied pressure to extend pistons 20 and 22 can come from the actual delivery of the cement 28 or a material that precedes it, as the pressure inside tubular 10 will be greater than the annulus 32 to provide the differential pressure to extend the pistons 20 and 22. Alternatively, they can be mechanically extended. However, it is preferred to first fully extend the pistons 20 and 22 with fluid pressure before pumping cement 28. In that way, the tubular 10 is securely centralized before cement 28 is delivered to annulus 32. FIG. 2 shows the set position where the leading end 24 is closed off and in contact with the wellbore 26. It should be noted that depending on the shape of the wellbore 26 and the total extension of the outer piston 20 and inner piston 22, some of the leading ends 24 might not be in contact with the wellbore 26 while others may be pressed against it or may have penetrated into wellbore 26. In an alternative embodiment, the piston 22 can be mounted in the reverse position than shown in the Figures, leaving an exposed edge as its leading edge. When so oriented in this manner, edge 36 can better dig into the wellbore 26, when extended outwardly by pressure or mechanical means to improve the fixation of the tubular 10 prior to cement delivery as well as after expansion.

Figure 3:
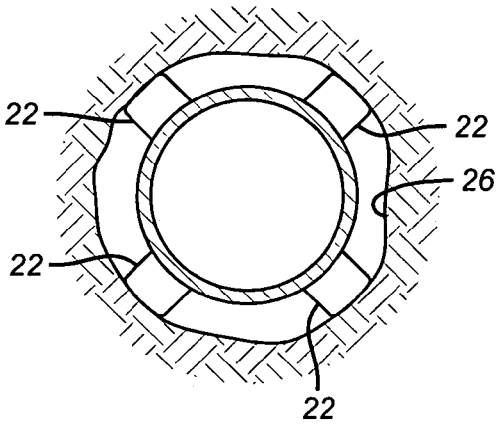
FIG. 3 is an end view in the borehole with the pistons expanded just prior to cementing.
Figure 4:
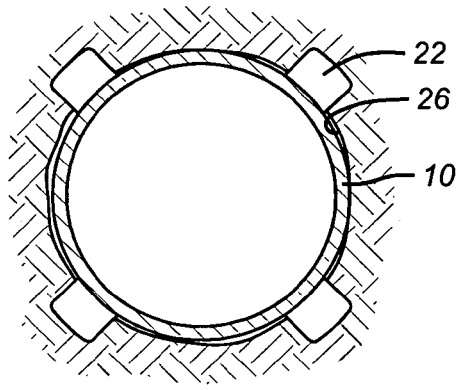
FIG. 4 is the view of FIG. 3 after cementing and expansion of the tubular into the cement.

As shown in FIG. 1, the tubular is expanded using any one of a variety of techniques. The expansion occurs before the cement 28 sets up. The expansion tool is shown schematically as 38 and can be a swage or a device employing applied pressure to the inside of the tubular 10. Since the pistons 20 and 22 are prevented from retracting into the tubular 10 they can dig into the borehole wall 26 as the tubular 10 is expanded. This occurs more easily with the piston 22 reversed from the orientation shown in the Figures due to exposure of edge 36. FIG. 3 shows the pistons 22 extended prior to cementing and FIG. 4 shows the tubular 10 expanded with the pistons 22 digging into the borehole wall 26. The pistons 20 and 22 fully compensate for some out of roundness of the borehole wall 26. Upon expansion, the tubular can conform to the shape of the borehole wall 26 or in some cases reshape the borehole wall 26 to a more round configuration. . An alternative embodiment could be where the tubular 10 is standing off of the borehole on the high side and subsequent expansion moves the pipe away from the low side towards the high side. However, even in this case, cement will be radially displaced around the pipe before expansion.

Those skilled in the art will appreciate that pistons 20 and 22 can be fully retracted for insertion of the tubular 10 into the borehole 26. The telescoping pistons 20 and 22 allow for the use of an effective system of centralization that will not hinder the ability to subsequently expand the tubular 10. Where in the past there have been either no centralizers used, in which cast the benefit of the cementing job may have been lost or where flexible wraparound centralizers were used which either impeded expansion or caused regions of high stress leading to tubular failure or just simply failed to function when made from non-metallic materials, the method of the present invention provides an effective way to centralize and accommodate the subsequent need to expand the tubular 10 into the cement 28 before it sets up. In this manner the cement 28 surrounds the tubular 10 and is further pushed into the wellbore as it sets up to enhance the sealing around the tubular 10 and decrease that possibility of longitudinal fluid channeling.

The foregoing disclosure and description of the invention are illustrative and explanatory thereof, and various changes in the size, shape and materials, as well as in the details of the illustrated construction, may be made without departing from the spirit of the invention.

We claim:

1. A method of positioning a tubular in a borehole defined by a wall, comprising:

delivering the tubular into the borehole;

fixating the tubular to the borehole wall, only after and not during said delivering, in a manner that leaves an annular space around it; and expanding the tubular.

2. The method of claim 1, comprising:

providing a plurality of openings in said tubular;

extending members from and relative to said openings;

said extendable members penetrating the wall to accomplish said fixating.

3. The method of claim 2, comprising:

keeping said extendable members substantially within said tubular for run in.

4. The method of claim 3, comprising:

allowing said extendable members to extend no further than an upset or a coupling at a joint on said tubular prior to extending.

5. The method of claim 2, comprising:

providing a closed end on at least one of said extendable members wherein said closed end is selectively driven toward the borehole wall.

6. The method of claim 2, comprising:

providing an open end on at least one of said extendable members wherein said open end is selectively driven toward the borehole wall.

7. The method of claim 2, comprising:

driving at least one of said extendable members toward the borehole wall with said expansion.

8. The method of claim 2, comprising:

driving at least one of said extendable members toward the borehole wall prior to said expansion.

9. The method of claim 8, comprising:

locking at least one of said extendable members against collapse after said driving.

10. The method of claim 8, comprising:

using internal pressure for said driving.

11. The method of claim 8, comprising:

using mechanical force for said driving.

12. The method of claim 2, comprising:

penetrating the borehole wall with at least one of said extendable members.

13. The method of claim 12, comprising:

providing an open leading end on at least one of said extendable members to facilitate said penetrating.

14. The method of claim 2, comprising:

delivering a sealing material under pressure through said tubular;

delivering the sealing material to said annular space;

expanding the tubular before the sealing material sets up.

15. The method of claim 14, comprising:

providing an open end and a closed end on at least one of said extendable members.

16. The method of claim 15, comprising:

driving one of said ends into the borehole with at least one of applied pressure or force from within the tubular and physical expansion of the tubular.

17. The method of claim 1, comprising:

expanding said tubular with a swage.

18. The method of claim 1, comprising:

expanding said tubular with internal pressure.

19. A method of positioning a tubular in a borehole, comprising:

delivering the tubular into the borehole;

positioning the tubular in the borehole in a manner that leaves an annular space around it; and expanding the tubular;

providing a plurality of openings in said tubular;

disposing an extendable member in each said opening;

driving at least one of said extendable members toward the borehole wall prior to said expansion;

using internal pressure for said driving;

delivering a sealing material under pressure through said tubular;

accomplishing said driving with said pressurized sealing material in said tubular;

delivering the sealing material to said annular space.

20. The method of claim 19, comprising:

expanding the tubular before the sealing material sets up.

* * * * *